US005513909A

United States Patent [19]

Teich

[11] Patent Number: 5,513,909

[45] Date of Patent: May 7, 1996

[54] APPLIANCE HINGE

[75] Inventor: Daniel E. Teich, Marion, Ill.

[73] Assignee: Maytag Corporation, Newton, Iowa

[21] Appl. No.: 284,302

[22] Filed: Aug. 2, 1994

[51] Int. Cl.[6] ..... A47B 96/00; E05D 1/00

[52] U.S. Cl. ..... 312/351.6; 16/383; 16/DIG. 13

[58] Field of Search ..... 16/225, DIG. 13, 16/382, 383; 312/351.6, 210, 228, 283, 140, 111, 327, 328, 290, 352; 49/381, 377, 403

[56] References Cited

U.S. PATENT DOCUMENTS

| | | | |
|---|---|---|---|
| 2,745,133 | 5/1956 | McWethy | 16/383 X |
| 3,441,975 | 5/1969 | Sheperd | 16/383 X |
| 4,089,467 | 5/1978 | Makowicki | 16/DIG. 13 |
| 4,131,971 | 1/1979 | Saarloos | 16/DIG. 13 |
| 4,254,640 | 3/1981 | Shere et al. . | |
| 4,268,098 | 5/1981 | Kretchman et al. . | |
| 4,574,425 | 3/1986 | Sugiura | 16/383 X |
| 4,618,193 | 10/1986 | Cuthbert et al. . | |
| 4,670,938 | 6/1987 | Fowlston | 16/383 X |
| 4,692,987 | 9/1987 | Cuthbert et al. . | |
| 4,787,121 | 11/1988 | Racenis et al. . | |
| 4,914,781 | 4/1990 | Sokn et al. . | |
| 4,988,149 | 1/1991 | Mulder et al. . | |

*Primary Examiner*—James R. Brittain
*Assistant Examiner*—Robert J. Sandy
*Attorney, Agent, or Firm*—Zarley, McKee, Thomte, Voorhees & Sease

[57] ABSTRACT

An appliance hinge connects a cabinet top to a cabinet base for pivotal movement therebetween. The hinge includes a first hinge member attached to the cabinet top and a second hinge member attached to the cabinet base. The first and second hinge members are pivotally connected to one another. One of the first and second hinge members includes a leg extending between the cabinet top and the cabinet base to prevent contact therebetween.

15 Claims, 3 Drawing Sheets

APPLIANCE HINGE

BACKGROUND OF THE INVENTION

This invention relates to an appliance cabinet hinge.

Typical appliances include a base cabinet and a cabinet top secured over the top of the cabinet base. Various means have been used for securing the cabinet top over the cabinet base.

Therefore a primary object of the present invention is the provision of an improved appliance hinge for joining a cabinet top to a cabinet base.

A further object of the present invention is the provision of an improved cabinet hinge which can be manufactured from plastic and which can either be molded or formed from an extrusion.

A further object of the present invention is the provision of an improved appliance hinge which can be attached to the cabinet top and cabinet base by a simple snap fitting of the hinge to the cabinet top and base.

A further object of the present invention is the provision of an improved appliance hinge that will minimize relative motion between the cabinet top and the cabinet base except for the pivoting motion necessary to open the cabinet top.

A further object of the present invention is the provision of an improved appliance hinge which separates and isolates the cabinet top and cabinet base from one another so as to eliminate metal to metal contact during operation of the appliance.

A further object of the present invention is the provision of a hinge which will easily fasten to the cabinet top and the cabinet base by insertion of clips into hinge mounting holes in the cabinet top and the cabinet base.

A further object of the present invention is the provision of a hinge that will easily fasten within hinge mounting holes in the cabinet top and base regardless of whether or not the hinge mounting holes are pierced with, or without burrs.

A further object of the present invention is the provision of an improved appliance hinge which is economical to manufacture, durable in use and efficient in operation.

SUMMARY OF THE INVENTION

The foregoing objects may be achieved with an appliance hinge used in combination with a cabinet base and a cabinet top. The cabinet base includes a plurality of upstanding side walls each of which comprise an inner surface, an outer surface, and a top edge. At least one of the side walls of the cabinet base includes a base flange extending inwardly from the top edge thereof. The appliance cabinet top includes a top panel, a side panel extending downwardly from the top panel and having a lower edge, and a top flange extending from the lower edge of the side panel in a direction parallel to and facing the base flange of the cabinet base.

The hinge includes first and second hinge members pivotally mounted to one another for pivotal movement about a hinge axis. The first hinge member is attached to the cabinet base and the second hinge member is attached to the cabinet top. The hinge axis is located adjacent the top edge of the one side wall of the cabinet base and the lower edge of the side panel of the cabinet top whereby the cabinet top and the cabinet base are pivotally connected to one another for pivotal movement about the hinge axis. One of the first and second hinge members includes a leg extending between the parallel top flange of the top cabinet and the base flange of the cabinet base to prevent contact therebetween.

DETAILED DESCRIPTION OF THE PREFERRED EMBODIMENT

Figure 1:
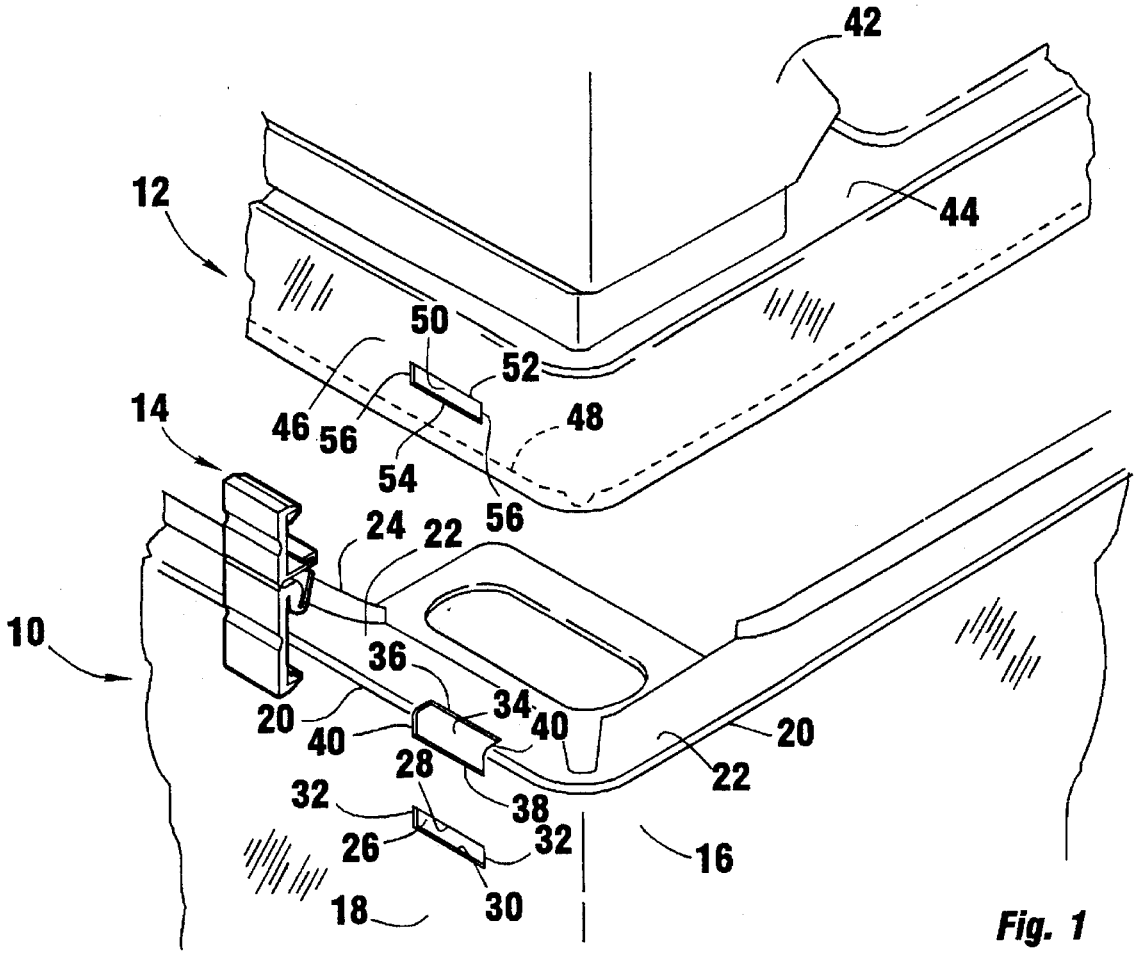
FIG. 1 is an exploded pictorial view showing a cabinet top, a cabinet base, and the hinge of the present invention.
Figure 2:
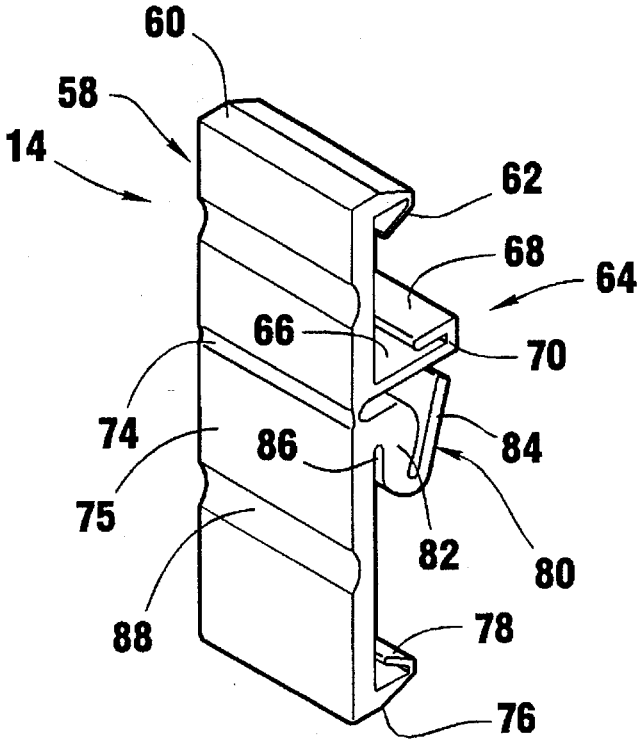
FIG. 2 a pictorial view of the hinge of the present invention its closed position.
Figure 3:
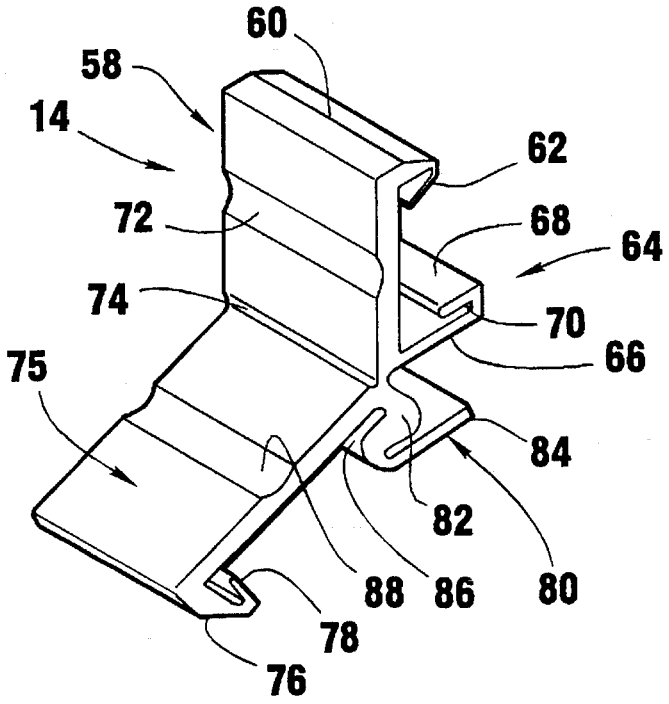
FIG. 3 is a view similar to FIG. 2, but showing the hinge in its flexed open position.

Referring to the drawings the numeral 10 generally designates a cabinet base which is adapted to be connected to a cabinet top 12 by means of a hinge 14. Cabinet base 10 includes side walls 16, 18 each of which includes a top edge 20 having a base flange 22 extending horizontally inwardly therefrom. Extending upwardly from the inner end of the base flange 22 is upstanding flange 24.

A lower opening 26 is provided in side wall 18 and includes an upper edge 28, a lower edge 30, and opposite side edges 32. A corner opening 34 is provided at the corner or juncture of the base flange 22 and the upstanding side wall 18. Corner opening 34 includes an upper edge 36, a lower edge 38, and two opposite side edges 40.

Cabinet top 12 includes a control panel 42, a top panel 44, and a side panel 46 extending around the margins of top panel 44. Extending inwardly from the lower edge of side panel 46 is a top flange 48. Side panel 46 includes an upper opening 50 therein which includes a top edge 52, a lower edge 54, and opposite side edges 56.

Hinge 14 includes an upper hinge member 58 having at its upper edge an upper clip 60 which in turn includes a doubled back spring finger 62 at its outer end. At the lower edge of upper hinge member 58 is a J-shaped clip 64 having a long leg 66, a short leg 68 and a slot 70 therebetween. Upper hinge member 58 includes a reduced thickness portion 72 which permits the upper hinge member 58 to flex about a horizontal axis.

Extending between the upper hinge member 58 and lower hinge member 75 is a living hinge 74. The entire hinge 14 is preferably formed from a plastic material and is of unitary construction. However, the hinge member 14 can be formed of separate parts, and the living hinge 74 may be varied in its construction from the living hinge structure shown in the drawings.

Hinge 14 also includes the lower hinge member 75 having at its lower edge a lower clip 76 which on its end includes a doubled back spring finger 78. At the upper edge of lower hinge member 75 is a V-shaped clip 80 which is comprised of a first leg 82 and a spring leg 84. The juncture between the first leg 82 and the remainder of lower hinge member 75 forms a slot 86. Lower hinge member 75 also includes a reduced cross section portion 88 which enables the lower hinge member 75 to flex about a horizontal axis.

The hinge 14 is used to assemble the cabinet top 12 to the cabinet base 10 in the following manner. First the upper hinge member 58 is attached to the cabinet top 12 by inserting top flange 48 of cabinet top 12 into the slot 70 of the J-shaped clip 64. The reduced thickness portion 72 permits flexing of the upper hinge member 58 during this process. Next the upper clip 60 is pivoted into the upper opening 50 of side panel 46. During insertion, the spring finger 62 is cammed inwardly to a folded position, but after the upper clip 60 has been fully inserted into the opening 50, the spring finger 62 springs back to its original normal locked position wherein it engages the interior surface of the side panel 46 as shown in FIG. 4.

Figure 4:
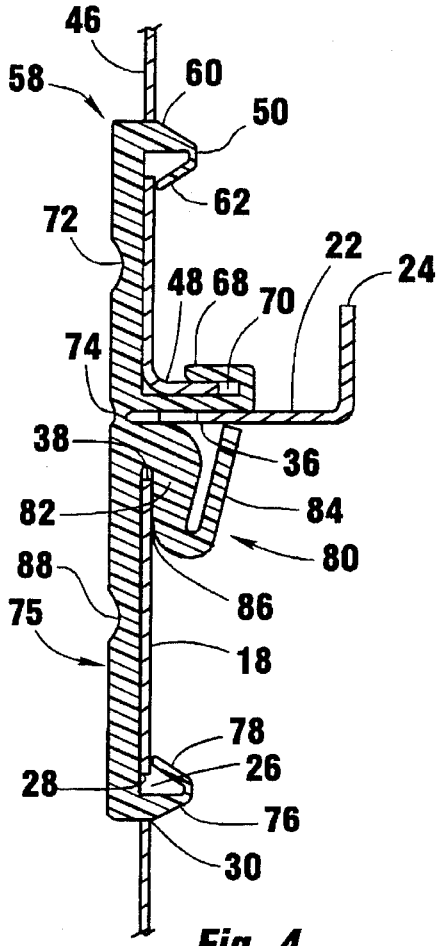
FIG. 4 is a sectional view showing the hinge in its closed position.
Figure 5:
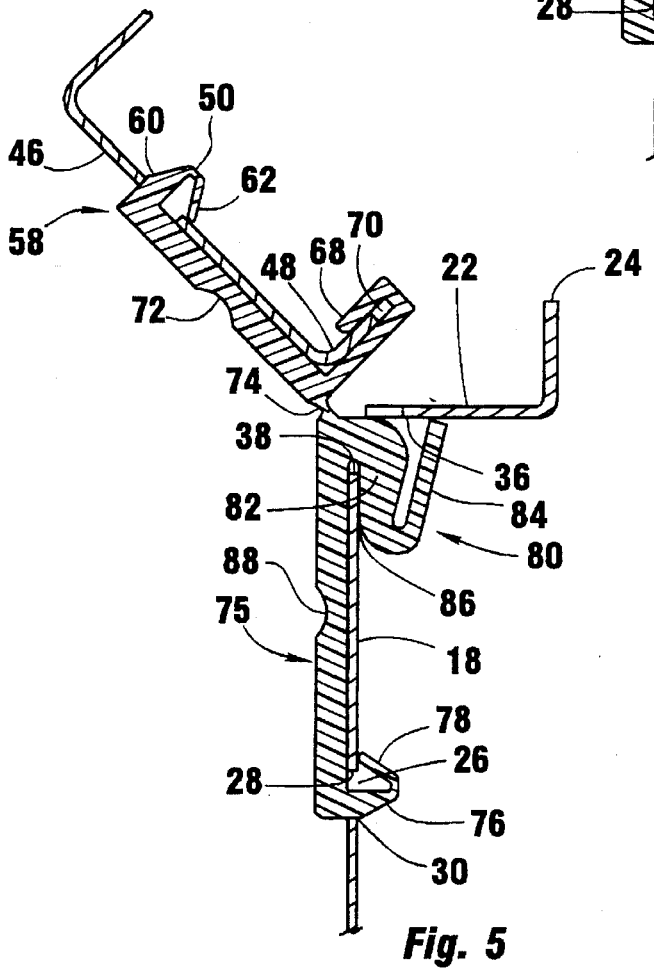
FIG. 5 is a sectional view similar to FIG. 4, but showing the hinge in its flexed open position.

Next, the V-shaped clip 80 is inserted downwardly into the corner opening 34 of cabinet base 10 with the lower edge 38 of the corner opening 34 being fitted within the slot 86 of the lower hinge member 75 as shown in FIG. 4. As the V-shaped clip 80 is inserted into corner opening 34, the spring leg 84 is cammed inwardly to a folded position. When clip 80 is fully inserted into corner opening 34, spring leg 84 will return to its original position, thereby locking clip 80 into corner opening 34. Upon completion of this process, the lower clip 76 is moved into the lower opening 26 and the spring finger 78 deflects to its folded position. Once the lower clip 76 has been completely inserted into the lower opening 26, the spring finger 78 springs outwardly to its locked position and engages the interior surface of the side wall 18 of base 10 thereby locking the lower clip member 75 to the cabinet base 10.

The side margins 32, 40, and 56 of the openings 26, 34, and 50 respectively are sized so as to prevent the hinge 14 from moving laterally therein, and this prevents side to side movement of the cabinet top 12 relative to the cabinet base 10.

The shape of the hinge is such that it can be formed either by extrusion or it can be injection molded using a "straight-pull" mold design. The hinge provides sufficient range of movement of the cabinet top to the cabinet base so that the cabinet top can be pivoted to a full open position for servicing.

One important feature of the present invention is the fact that the long leg 66 of the J-shaped clip 64 is inserted between the top flange 48 of the cabinet top 42 and the base flange 22 of the cabinet base 10 so that the cabinet top 12 and the cabinet base 10 are isolated from one another and are prevented from metal to metal contact with respect to one another. The plastic of the long leg 66 further provides a cushion between the cabinet top 12 and the cabinet base 10.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. In combination:

an appliance cabinet base having a plurality of upstanding side walls each of which comprise an inner surface, an outer surface, and a top edge, at least one of said side walls having a base flange extending inwardly from said top edge thereof;

an appliance cabinet top comprising a top panel, a side panel extending downwardly from said top panel and having a lower edge, and a top flange extending from said lower edge of said side panel in a direction parallel to and facing said base flange of said cabinet base;

a hinge having first and second hinge members pivotally mounted to one another for pivotal movement about a hinge axis, said first hinge member being attached to said cabinet base, and said second hinge member being attached to said cabinet top with said hinge axis being located adjacent said top edge of said one side wall of said base and said lower edge of said side panel of said cabinet top, whereby said cabinet top and said cabinet base are pivotally connected to one another for pivotal movement about said hinge axis;

one of said first and second members including a leg extending between said top flange of said cabinet top and said base flange of said cabinet base and preventing contact between said cabinet base and said cabinet top so as to isolate them from one another.

2. A combination according to claim 1 wherein said hinge is comprised of a plastic material.

3. A combination according to claim 1 wherein said hinge is of unitary plastic construction.

4. A combination according claim 1 wherein said leg extends from said second hinge member and retentively engages said top flange of said cabinet top.

5. A combination according to claim 4 wherein said leg is J-shaped and includes two spaced apart J-members joined by a J-web, said two spaced apart J-members embracing said top flange of said cabinet top therebetween.

6. The combination of claim 1 wherein said top flange includes an inner flange edge extending generally parallel to said lower edge of said side panel, said leg of said one of said first and second members extending below said top flange, around said inner flange edge of said flange and above said top flange.

7. A hinge for use in joining an appliance cabinet base to an appliance cabinet top for hinged movement with respect to one another, said cabinet base having plurality of upstanding side walls each of which comprise an inner surface, an outer surface, and a top edge, at least one of said side walls having a base flange extending inwardly from said top edge thereof, said appliance cabinet top comprising a top panel, a side panel extending downwardly from said top panel and having a lower edge, and a top flange extending from said lower edge of said side panel in a direction parallel to and facing said base flange of said cabinet base; said hinge comprising:

a first hinge member;

a second hinge member connected to said first hinge member for pivotal movement therebetween about a hinge axis;

said first hinge member having a first clip member and a second clip member extending therefrom, said first clip member having a spring finger adapted to yieldably move from a locked position to a folded position, said second clip member having a slot and a spring finger adapted to yieldably move from a locked position to a folded position;

said second hinge member having a third clip member and a fourth clip member extending therefrom, said third clip member being J-shaped, and said fourth clip member having a spring finger adapted to yieldably move from a lock position to a folded position.

8. A hinge according to claim 7 wherein each of said first and second hinge members is formed of plastic.

9. A hinge according to claim 8 wherein said entire hinge is of unitary construction and is formed of plastic.

10. A hinge according to claim 9 wherein each of said first and second hinge members includes a reduced cross sectional portion for permitting flexing of said first and second hinge members.

11. A hinge according to claim 7 wherein a leg portion of said third clip member extends between said top flange of said cabinet top and said base flange of said cabinet base to prevent contact between said cabinet base and said cabinet top.

12. In combination:

an appliance cabinet base having a plurality of upstanding side walls each of which comprise an inner surface, an outer surface, and a top edge, at least one of said side walls having a base flange extending inwardly from said top edge thereof;

an appliance cabinet top comprising a top panel, a side panel extending downwardly from said top panel and having a lower edge, and a top flange extending from said lower edge of said side panel in a direction parallel to and facing said base flange of said cabinet base;

a hinge having first and second hinge members pivotally mounted to one another for pivotal movement about a hinge axis, said first hinge member being attached to said cabinet base, and said second hinge member being attached to said cabinet top with said hinge axis being located adjacent said top edge of said one side wall of said base and said lower edge of said side panel of said cabinet top, whereby said cabinet top and said cabinet base are pivotally connected to one another for pivotal movement about said hinge axis;

said one side wall of said cabinet base including a first opening and a second opening therein, said first and second openings of said one side wall of said cabinet base being separate and spaced apart from one another;

said first hinge member having a first clip member protruding within and retentively held within said first opening of said one side wall and a second clip member protruding within and retentively held within said second opening of said one side wall;

said second hinge member having a first clip member protruding within and retentively held within said first opening of said side panel of said cabinet top.

13. A combination according to claim 12, wherein said first clip members of said first and second hinge members respectively each include a spring finger adapted to yieldably fold in response to said first clip members being inserted into said first openings in said side wall of said cabinet base and in said side panel of said cabinet to respectively, and being adapted to spring to a locked position holding said first clip members in said first openings after said first clips have been inserted into said first openings.

14. A combination according to claim 13 wherein said second opening in said one side wall of said cabinet base includes an upwardly presented edge, said second clip member of said first hinge member including a slot and a spring finger, said upwardly presented edge of said second opening being fitted within said slot, and said spring finger of said second clip member being yieldable to a folded position during insertion of said second clip member into second opening, and being yieldably moveable to a locked position holding said second clip member within said second opening after said second clip member has been inserted into said second opening.

15. A combination according to claim 12 wherein said first and second hinge members each have a reduced cross sectional portion spaced from said hinge axis for permitting flexing of said first and second hinge members during insertion of said first and second clip members into said first and second openings.

* * * * *